United States Patent [19]

Uke

[11] Patent Number: 4,978,043

[45] Date of Patent: Dec. 18, 1990

[54] HANGER FOR WETSUIT ACCESSORIES AND THE LIKE

[76] Inventor: Alan K. Uke, 5980 Rancho Diegueno, P.O. Box 8531, Rancho Santa Fe, Calif. 92067

[21] Appl. No.: 466,024

[22] Filed: Jan. 17, 1990

[51] Int. Cl.[5] ..... A47G 25/60; A47G 25/28; A47G 25/34

[52] U.S. Cl. ..... 223/88; 223/85; 223/87; 211/113

[58] Field of Search ..... 223/85, 88, 92, 95, 223/87; D6/315; 211/113

[56] References Cited

U.S. PATENT DOCUMENTS

| | | | |
|---|---|---|---|
| D. 204,039 | 3/1966 | Phillips et al. | 223/85 |
| 2,171,693 | 10/1939 | Glendeming | 223/95 |
| 2,834,475 | 5/1958 | Reich | 271/113 |
| 3,138,259 | 6/1964 | Sitt | 223/88 |
| 3,517,823 | 6/1970 | Papinéau | 223/88 |
| 4,632,286 | 12/1986 | Koyama | 223/88 |
| 4,768,657 | 10/1988 | Lonow | 211/113 |

*Primary Examiner*—Werner H. Schroeder
*Assistant Examiner*—Bibhu Mohanty
*Attorney, Agent, or Firm*—Brown, Martin Haller & McClain

[57] ABSTRACT

The present invention is a device for supporting wetsuit accessories such as gloves, booties and hoods for drying and storage. The hanger is comprised of a hook having an elongated neck coupled thereto with a crossbar coupled to the neck opposite the hook. A pair of outer fingers are each coupled to a respective end of the crossbar with each outer finger extending in a direction towards the hook. A pair of inner fingers are each respectively coupled to the crossbar on opposite sides of the neck intermediate of a respective outer finger with each extending in an upward direction towards the hook. An arm is coupled to the crossbar and has a portion extending in a spaced apart relationship therefrom opposite the neck and fingers.

13 Claims, 2 Drawing Sheets

HANGER FOR WETSUIT ACCESSORIES AND THE LIKE

BACKGROUND OF THE INVENTION

The present invention relates to a device for supporting wetsuit accessories. More specifically, the present invention relates to a novel and improved hanger for supporting wetsuit accessories for drying and storage.

Hangers for clothing and other articles are well known in the art. The most typical type of hangers are formed having a triangular base portion. Extending upwardly from the base portion is a neck having a hook formed at an end thereof. Typically such hangers are configured for holding lightweight to medium weight articles of clothing.

In the sport of diving and snorkeling, or other aquatic sports, wetsuits and wetsuit accessories are utilized. Difficulties are often encountered in supporting these items for drying. Typically they are draped over a clothes line or laid down. It is preferable to have a heavy duty hanger of a construction sufficient to support the weight of a wet wetsuit and wetsuit accessories for drying. One such wetsuit hanger design is disclosed in Applicant's co-pending U.S. Design patent application Ser. No. 07/278,166 filed Nov. 30, 1988, entitled "GARMENT HANGER FOR WETSUITS AND THE LIKE". The design disclosed in the just-mentioned application is of an I-beam type cross-section and formed from a rigid plastic material sufficient to support the weight of a hung wetsuit for drying.

In the sport of diving, wetsuit accessories are commonly used. Accessories such as gloves, booties and hoods are wellknown. The hangers commonly used do not readily facilitate supporting these articles for drying or storage. Previous designs for hangers do not facilitate supporting of such articles sufficient to enable support of the articles without crimping or folding so as to permit expedient drying.

It is therefore an object of the present invention to provide a novel and improved hanger for supporting wetsuit accessories.

SUMMARY OF THE INVENTION

The present invention is a novel and improved hanger for supporting wetsuit accessories such as gloves, booties and hoods for drying and storage. The hanger is comprised of a hook having an elongated neck coupled thereto with a crossbar coupled to the neck opposite the hook. A pair of outer fingers are each coupled to a respective end of the crossbar with each outer finger extending upwardly in a direction toward the hook. A pair of inner fingers are included with each respectively coupled to the crossbar on opposite sides of the neck, intermediate of a respective outer finger, with each extending upwardly in a direction toward the hook. An arm is coupled to the crossbar and has a portion extending in a spaced apart relationship therefrom opposite the neck and fingers.

BRIEF DESCRIPTION OF THE DRAWINGS

The features, objects and advantages of the present invention will become more apparent from the detailed description of the preferred embodiment of the present invention in which like reference characters correspond throughout and wherein.

DETAILED DESCRIPTION OF THE PREFERRED EMBODIMENT

Figure 1:
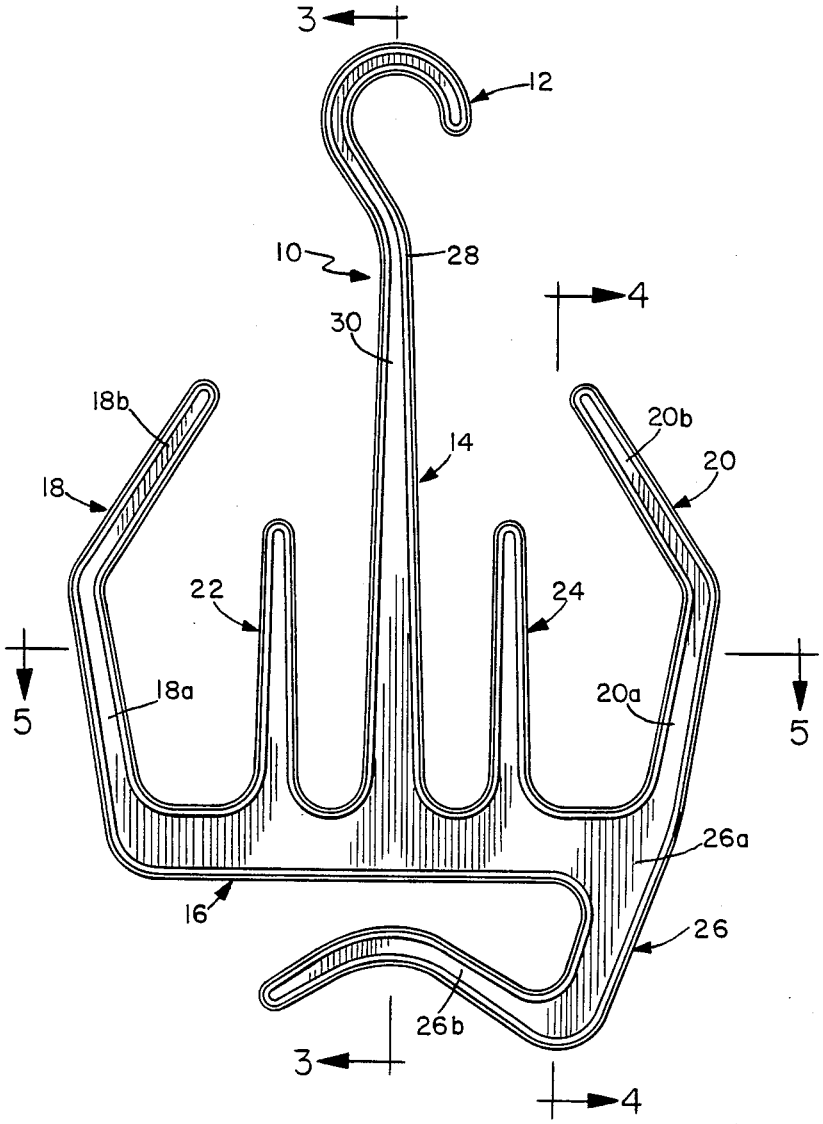
FIG. 1 is a side elevation vide of the hanger of the present invention.

Turning now to the drawings, FIG. 1 illustrates an exemplary embodiment of the present invention in a side elevation view. Hanger 10 is preferably constructed as a unitary article using conventional injection molding techniques. Hanger 10 is preferably constructed from a noncorrosive material, such as plastic, which provides a durable, rigid body.

Hanger 10 is comprised of a hook 12 formed at an upper end of elongated neck 14. At the other end of neck 14, opposite hook 12, is formed crossbar 16. At the outermost ends of crossbar 16 are formed upwardly extending outer fingers 18 and 20. Intermediate of neck 14 and outer finger 18 and 20 are fingers 22 and 24 which are formed to extend upwardly from crossbar 16. At one end of crossbar 16 is formed arm 26 which extends downwardly from crossbar 26 and then extends towards the other end of crossbar 16 while remaining spaced apart therefrom.

Hanger 10 is formed from a continuous peripheral rail or flange 28 which is interconnected by a substantially planar web 30. Web 30 intersects flange 28 at approximately midway of the width of flange 28. Flange 28 and web 30 give hanger 10 an I-beam construction. Such I-beam construction provides additional rigidity to the hanger for supporting heavy or wet wetsuit articles for drying.

Neck 14 is typically perpendicular to crossbar 16 with web 30 tapering slightly in width as it extends away from crossbar 16 towards hook 12. Hook 12 has a center of curvature located at a point on a center longitudinal axis extending along the length of neck 14.

Spaced apart from neck 14 on opposite sides thereof are inner fingers 22 and 24. Fingers 22 and 24 extend upwardly from crossbar 16. Fingers 22 and 24 each define a longitudinal axis which extends the length thereof, such axes parallel to the axis defined by neck 14. Fingers 22 and 24 may also have web 30 slightly tapered in width as they extend upwardly from crossbar 16.

Formed at opposite ends of crossbar 16 are outer fingers 18 and 20. Outer finger 18 is respectively comprised of lower finger portion **18*a* and upper finger portion 18*b*. Similarly, outer finger 20 is comprised of lower finger portion 20*a* and upper finger portion 20*b*. Both lower finger portions 18*a* and 20*a* extend upwardly and outwardly from crossbar 16 at a slight angle. Upper finger portions 18*b* and 20*b* respectively extend from lower finger portions 18*a* and 20*a* upwardly and inwardly at an angle toward neck 14. Both lower fingers portions 18*a* and 20*a* along with upper finger portions 18*b* and 20*b* may also have web 30** taper slightly in width.

At the end of crossbar 16 where outer finger 20 is formed, arm 26 is also formed. Arm 26 extends in a direction downwardly, i.e. opposite direction of extension of finger 20. Arm 26 is comprised of an extension portion 26*a* which extends downwardly and at an angle inwardly towards neck 18. Extending from extension portion 26*a* is support portion 26*b* which extends in a direction towards the other end of crossbar 16 where outer finger 18 is formed. Support portion 26*b* is formed in an upward bow configuration. Arm 26 may also have web 30 slightly taper in width as it extends from crossbar 16.

Figure 2:
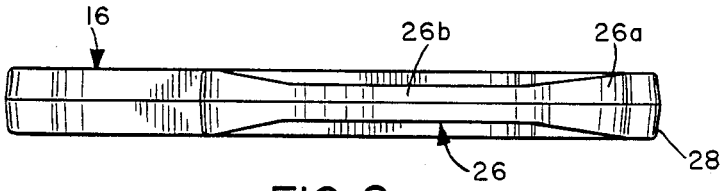
FIG. 2 is a bottom plan view of the hanger of FIG. 1.

FIG. 2 illustrates hanger 10 as viewed from the bottom. In FIG. 2, flange 28, along the outermost or bottom edge of extension portion 26*a* opposite the gap formed between crossbar 16 and arm 26, tapers in width as it extends downwardly towards support portion 26*b*. Flange 28 is of a narrower width on the bottom edge of support portion 26*b* until the downward bow in support portion 26*b* is reached. At this point the width of flange increases to the nominal width at the end of support portion 26*b*. Flange 28 forming the upper edge of support portion 26*b* and extension portion 26*a* and along with the bottom edge of crossbar 16 is also of the nominal width.

Figure 3:
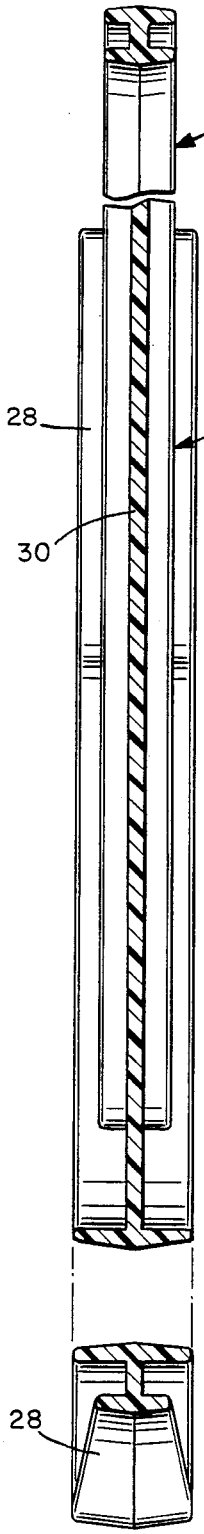
FIG. 3 is an enlarged sectional view taken on line 33 of FIG. 1.

Referring now to FIG. 3, the increase in the width of flange 28 at the outward edge of arm 26 is further illustrated in a cross-section taken along line 3—3 of FIG. 1. Furthermore in neck 14 the width of flange 28 is also narrowed and constant throughout in width. Flange 28 from lower finger portion 18*a*, running continuously along inner finger 22, neck 14, hook 12, inner finger 24, to lower finger portion 20*a* is also narrow in width.

Figure 4:
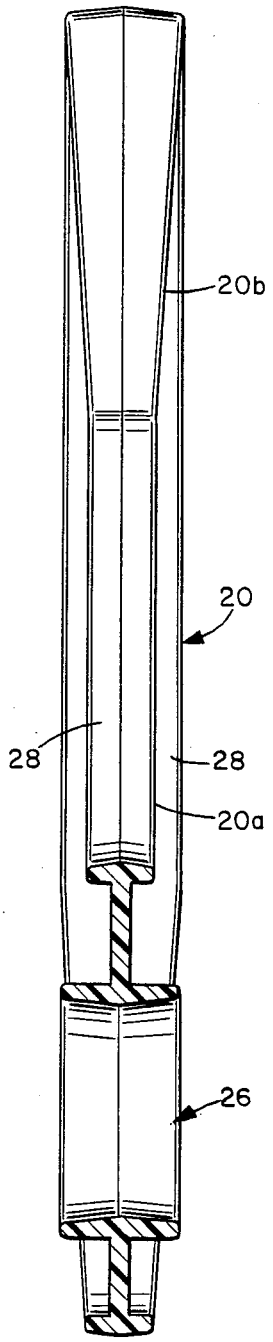
FIG. 4 is an enlarged sectional view taken on line 44 of FIG. 1.

FIG. 4 illustrates in further detail the varying widths of hanger 10 as taken in cross-section along line 4—4 of FIG. 1 As illustrated in FIG. 4, flange 28 on the inside edge of lower finger portion 20*a* facing finger 24 is narrow in width. As flange 28 extends upwardly for the inner edge of upper finger portion 20*b*, it increases in width to the nominal width. Flange 28 as it extends along on the outer edge of finger 20 is of the nominal width. Finger 18 is similarly constructed to that of finger 20 with the outer edge defined by flange 28 being of a nominal width and the inner edge tapering to a narrow width.

Figure 5:
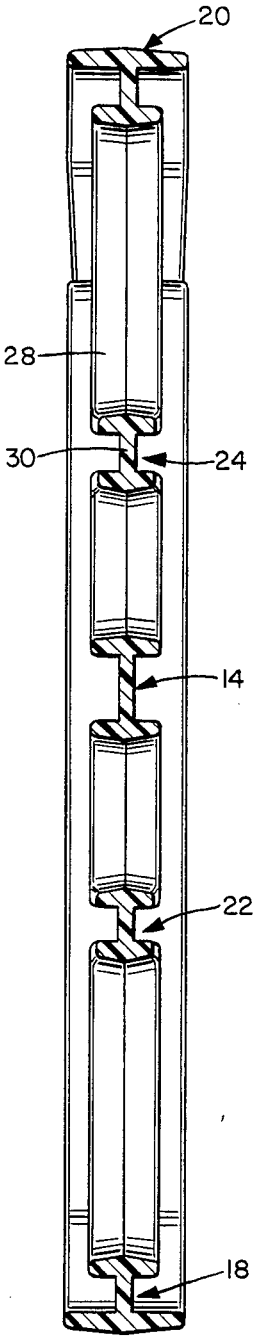
FIG. 5 is an enlarged sectional view taken on line 55 of FIG. 1 and rotated 90 degrees for convenience in illustration.

FIG. 5 illustrates a cross-sectional view taken across line 5—5 of FIG. 1 and viewed from the top. FIG. 5 illustrates the narrow width of flange 28 as it forms with web 30 the interior region between outer fingers 18 and 20, inner fingers 22 and 24 along with neck 14.

In the embodiment illustrated in the accompanying drawings the nominal width of flange 28 is approximately $1\frac{1}{4}''$ and where it narrows is approximately 182" in width. Flange 28 is approximately 3/16" in thickness. Web 30 is approximately $\frac{1}{8}''$ thickness. Neck 14 and hook 12 extend approximately 15" from crossbar 16.

Inner fingers 22 and 24 extend upwardly from crossbar 16 by approximately $5\frac{1}{2}''$. Outer fingers 18 and 20 extend upwardly from crossbar 16 by about $8\frac{1}{2}''$. Inner fingers 22 and 24 are spaced apart from neck 14 forming a gap in range of $1\frac{1}{4}''$ to $1\frac{1}{2}$.

Outer fingers 18 and 20 provide approximately a $2\frac{1}{2}''$ gap respectively, measured at the intersection of crossbar 16, from a corresponding inner finger. Lower finger portions 18*a* and 20*a* extend upwardly from crossbar 16 and angle outwardly at an angle of approximately 10 degrees from a vertical axis parallel to the axis of neck 14. Upper finger portions 18*b* and 20*b* extend upwardly and inwardly at an angle of approximately 45 degrees from an axis defined by the length of lower finger portions 18*a* and 20*a*. Lower finger portions 18*a* and 20*a* extend upwardly from crossbar 16 by approximately $4\frac{1}{2}''$ while upper finger portions 18*b* and 20*b* extend from the respective lower finger portions 18*a* and 20*a* also approximately $4\frac{1}{2}''$ in length. The overall width of hanger 10 from the outermost edges of outer fingers 18 and 20 is approximately 13".

Crossbar 16 is approximately 11" in width and approximately $1\frac{1}{2}''$ in height. Extension portion 26*a* extends downwardly from crossbar 16 by approximately 3". Support portion 26*b* is approximately $7\frac{1}{4}''$ in length and with the upward bow extends approximately 6" from extension portion 26*a*. The upward bow formed in portion 26*b* is approximately $1\frac{1}{4}''$ so as to define a minimal spacing between crossbar 16 and support portion 26*b* of approximately 1". The overall height of hanger 10 is approximately 19".

In an exemplary application of the present invention, hanger 10 is used to support wetsuit accessories particularly for drying or storage. Hanger 10 may be hung over a conventional clothes line or other supporting member. Inner fingers 22 and 24 are typically utilized to support wetsuit gloves made of typically of a neoprene material. The gloves are placed cuffs down on inner fingers 22 and 24 so that water may drip from the gloves.

Outer fingers 28 and 20 are utilized for supporting wetsuit booties also typically made of a neoprene material. The booties are typically placed over outer fingers 18 and 20 with the top portion of the toe area of the boot facing inwardly towards neck 14 and fingers 22 and 24. In this configuration water is allowed to drain out of the booties and further facilitate drying of the booties. The angle in outer fingers 18 and 20 provide shape support to the booties.

A wetsuit hood may further be placed upon arm 26 with the hood open face facing extension portion 26*a*. In this configuration contoured support of the hood is provided which facilitates drainage of water therefrom so as to greatly enhance drying, and in addition provides general shape support to the hood.

Fabrication of the hanger of the present invention is preferably accomplished by using plastic injection molding techniques. Use of a rigid plastic material which provides some flex is preferred. Although plastic is the preferred material, since it prevents corrosion and damage to gear hung on the hanger, other materials of similar non-corrosive characteristics may be used. A design of I-beam construction of integrally formed elements provides enhanced structural rigidity. Although the hanger is illustrated herein having a flange of varying widths the flange may be of a constant width or other width designs.

The hanger of the present invention is configured to maintain the intended shape of the neoprene accessories hung upon the hanger. The design of the present invention provides downward positioning of the articles hung thereupon for dripping and drying. Furthermore the design provides for spaced apart placement of the articles which further facilitates drying.

The previous description of the preferred embodiment is provided to enable any person skilled in the art to make or use the present invention. Various modifications to this embodiment will be readily apparent to those skilled in the art, and the generic principles defined herein may be applied to other embodiments without the use of the inventive faculty. Thus, the present invention is not intended to be limited to the embodiments shown herein, but is to be accorded the widest scope consistent with the principle and novel features disclosed herein.

I claim:

1. A hanger comprising:

a hook;

an elongated neck coupled to said hook;

a crossbar coupled to said neck opposite said hook;

a pair of outer fingers each coupled to a respective end of said crossbar, each outer finger extending in a direction of said hook;

a pair of inner fingers each respectively coupled to said crossbar on opposite sides of said neck intermediate of a respective outer finger each inner finger and parallel to said neck;

an arm coupled to said crossbar and having a portion extending in a spaced apart relationship therefrom opposite said neck and finger.

2. The hanger of claim 1 wherein said hook, said neck, said crossbar, said inner and outer fingers, and said arm are integrally formed from a rigid material.

3. The hanger of claim 2 wherein said hook, said neck, said crossbar, said inner and outer fingers, and said arm are formed by a peripheral flange interconnected by a web, said flange and web defining an I-shaped cross-section.

4. The hanger of claim 1 wherein said inner fingers are symmetrically spaced apart from said neck and are substantially parallel to said neck.

5. The hanger of claim 1 wherein said outer fingers are, for a first distance from said crossbar, angled outwardly with respect to said neck as they extend from said crossbar and, for a second distance from said first distance, angled inwardly with respect to said neck as they extend from said crossbar.

6. A hanger for wetsuit accessories comprising:

a crossbar;

an elongated neck integrally formed with and extending upwardly from said crossbar;

a hook integrally formed with and extending from said neck opposite said crossbar;

a pair of outer fingers integrally formed with and extending upwardly from said crossbar at outer ends thereof;

a pair of inner fingers integrally formed with and extending upwardly from said crossbar each on an opposite side of said neck spaced apart from said neck and a respective outer finger; and an arm member integrally formed with and extending below said crossbar.

7. The hanger of claim 6 wherein said arm member comprises:

an extension portion extending downwardly from one end of said crossbar; and a support portion extending from said extension portion in a direction of said crossbar other end.

8. The hanger of claim 7 wherein said support portion is upwardly bowed.

9. The hanger of claim 6 wherein each outer finger has a first portion extending upwardly and angle outwardly from said crossbar and a second portion extending upwardly and inwardly from said first portion.

10. The hanger of claim 6 wherein said neck and inner fingers extend perpendicularly from said crossbar.

11. The hanger of claim 6 wherein said hook is offset from said neck with said hook having a center of curvature located on a central axis extending the length of said neck.

12. The hanger of claim 6 wherein said crossbar, neck, inner and outer fingers, and arm are formed of a rigid plastic material.

13. The hanger of claim 6 wherein said crossbar, neck, hook, inner and outer fingers, and arm are formed by a peripheral flange interconnected by a web defining an I-shaped crosssection.

* * * * *